US006575340B2

(12) United States Patent
Steinel et al.

(10) Patent No.: US 6,575,340 B2
(45) Date of Patent: Jun. 10, 2003

(54) ADHESIVE CARTRIDGE

(75) Inventors: Heinrich Wolfgang Steinel, Bad Wörishofen (DE); Andre Schomäcker, Harsewinkel (DE)

(73) Assignee: Steinel GmbH & Co. KG, Herzebrock-Clarholz (DE)

( * ) Notice: Subject to any disclaimer, the term of this patent is extended or adjusted under 35 U.S.C. 154(b) by 0 days.

(21) Appl. No.: 09/945,988

(22) Filed: Sep. 4, 2001

(65) Prior Publication Data

US 2002/0040914 A1 Apr. 11, 2002

(30) Foreign Application Priority Data

Sep. 5, 2000 (DE) ..... 200 15 373 U
Mar. 2, 2001 (DE) ..... 201 03 649 U

(51) Int. Cl.[7] ..... B65D 88/54
(52) U.S. Cl. ..... 222/326; 222/146.2

(58) Field of Search ..... 222/325, 326, 222/146.2, 146.5, 83

(56) References Cited

U.S. PATENT DOCUMENTS 1,830,283 A * 11/1931 Madderra ..... 111/92
3,687,339 A * 8/1972 Dessureault ..... 222/183
4,642,158 A * 2/1987 Steinel et al. ..... 156/497
5,026,187 A * 6/1991 Belanger et al. ..... 401/1
5,297,697 A * 3/1994 Boring ..... 222/83

* cited by examiner

*Primary Examiner*—Ehud Gartenberg
*Assistant Examiner*—Melvin A Cartagena
(74) *Attorney, Agent, or Firm*—Bachman & LaPointe, P.C.

(57) ABSTRACT

An adhesive cartridge which is adapted to receive adhesive which is liquid or which is to be liquefied under the influence of heat and is usually used together with a hot-melt applicator device which provides for a suitable supply of heat.

11 Claims, 3 Drawing Sheets

ADHESIVE CARTRIDGE

BACKGROUND OF THE INVENTION

The present invention concerns an adhesive cartridge which is adapted to receive adhesive which is liquid or which is to be liquefied under the influence of heat and is usually used together with a hot-melt applicator device which provides for a suitable supply of heat.

Hot-melt adhesive applicator devices of that kind, as are described for example in the applicants' German patent application No 100 10 304.9 make it possible, in a flexible procedure which is advantageous in terms of handling, to heat an adhesive which is suitably selected according to the respective area of use involved, in an associated cartridge, to the operating temperature, and then apply it by means of a unit in the form of a gun, so that it is possible to make use of the advantages of a hot-melt adhesive under a large number of conditions of use.

A particular advantage of such applicator devices is moreover that the modularity of the entire device, which is achieved by virtue of using cartridges, not only makes it possible to interchange various adhesive cartridges (which ideally are suitably identified), but rapid and efficient re-filling is also possible in a continuous operating procedure.

In practice however it has been found that there is the disadvantage that a (typically cylindrical) adhesive cartridge for hot-melt adhesive could not be fixed in its position within the heating element of an applicator device, so that problems arose in particular in regard to the transfer of heat from the heating element to the cartridge body and consequently then when heating the hot-melt adhesive contained in the cartridge body. At the same time, in consideration of a heating element which typically is embodied in the form of an aluminum extrusion of cylindrical internal cross-section, the provision of any elements which fix a relative position of the cartridge and the heating element with respect to each other was ruled out. Other conventional constructions such as for example screwing in the cartridge in contrast appear to be time-consuming and, particularly in consideration of the risk of contamination due to adhesive which has escaped, impracticable from the point of view of practical operation.

A further problem with cartridges of the general kind specified, which arises out of the principle involved, is that accurate metering of the medium in the cartridge, in particular the adhesive, can be achieved only with difficulty: as a filled cartridge (filled with liquid adhesive or adhesive to be liquefied) is to be considered as a closed or self-contained system, in which case the medium is discharged from the spout portion by actuation of the piston element from the opposite end of the cartridge body (with an increase in pressure that this entails, by virtue of compression of the medium in the cartridge), pressure equalisation is effected only by way of the discharge end or the spout portion. Emptying of the cartridge takes place until pressure equalisation has occurred between atmospheric pressure and the pressure within the cartridge, and this has the effect that the medium (adhesive) then still also issues from the cartridge although the piston is no longer being moved.

Particularly in the present context of use, namely applying liquid adhesive issuing from the spout portion, such a situation is unsatisfactory for, as will be appreciated, it is precisely a hot-melt adhesive which is used by virtue of its advantageous adhesive properties that must be accurately metered, and contamination caused by adhesive which unintentionally issues gives rise to unnecessary cleaning expenditure and complication and gives rise to specific practical problems in the area surrounding the position of application.

The object of the present invention is to facilitate the handleability of adhesive cartridges within an associated applicator device and in particular to improve the transmission of heat from a heating element to the adhesive cartridge. Another object of the present invention is to improve the handleability of adhesive cartridges of the general kind set forth, in regard to precisely meterable discharge of adhesive from the discharge end by actuation of the piston end, in particular insofar as discharge (outflow) of adhesive from the discharge end is to be prevented as soon as the piston element is not subjected to any pressure acting thereon (that is to say in particular unintentional discharge flow of adhesive is to be prevented).

SUMMARY OF THE INVENTION

The foregoing objects are attained by a device having an adhesive cartridge for accommodating liquid adhesive or adhesive which is to be liquefied and for insertion into a hot-melt adhesive applicator device, comprising a cylindrical cartridge body which is adapted for heating by a heating element of the hot-melt adhesive applicator device, which heating element acts on the cartridge at the periphery thereof in an at least region-wise manner, which cartridge body is adapted at one end for closure with an insertable piston element and at the other end has a spout portion providing an internal cross-section which is reduced with respect to the cylindrical cartridge body and which has an outlet end, wherein the adhesive cartridge has means for preventing rotation of the adhesive cartridge in an inserted condition relative to the hot-melt adhesive applicator device and/or relative to the heating element.

In a manner which is advantageous in accordance with the invention the rotation-preventing means provided on the adhesive cartridge in accordance with a first embodiment of the invention provide for a clearly defined, firm fit for the cartridge in the heating element so that play can be reduced and heat transfer can be improved. As a consequence, the handling properties are thereby markedly improved in practical use, and not least also, for example in an operative condition of the applicator device in which it is separated from a basic power supply, the adhesive contained in the cartridge remains fluid for use over a longer period of time.

In that respect it has proven to be particularly preferable in practical use for the rotation-preventing means to be provided in the region of the spout portion of the adhesive cartridge, that is to say, it is preferable for the rotation-preventing means to be so designed that it is (only) in a fully inserted condition of the cartridge into the heating element that the rotation-preventing means is in an engaging condition and provides for the advantageous fixing effect. Associated receiving means for the rotation-preventing means which in a further preferred feature are in the form of projections can then be provided in the applicator device outside the heating element and are thus both remote from the heat source heating element and also uninfluenced by any adhesive residues which can issue from the discharge end of the cartridge. The advantageous handling properties are therefore further enhanced by virtue of that measure.

It has also proven to be particularly preferable for the projections providing the rotation-preventing means to be arranged in a star configuration and in accordance with a further preferred feature to be formed in one piece out of a (metal) material providing the spout so that, with the best possible securing action to prevent rotational movement, the projections are still easy to shape and the associated tooling costs for manufacturing installations remain low.

Aluminum has proven to be a particularly advantageous material for heat transfer as it is particularly heat-conductive so that in accordance with a further preferred embodiment of the invention the adhesive cartridge is made from aluminum, in which case in accordance with a further preferred feature the spout portion is also formed integrally on the cylindrical cartridge body.

For the purposes of reliable (re-)closure of the discharge opening after use, it has proven desirable to provide a suitable closure cap for the adhesive cartridge, which cap in accordance with a development of the invention is fixed by a screw action on to a screwthread provided on the spout portion. To provide protection from contamination and fouling (for example due to the issue of adhesive) it has proven advantageous in that respect for that male screwthread to be provided in the spout portion as closely as possible to the cylindrical cartridge body.

In accordance with a second embodiment of the invention the valve means provided in accordance with the invention provide that, due to the predetermined counteracting pressure, any adhesive that issues first has to overcome a corresponding force before a discharge flow can take place. That occurs however only when the piston element is intentionally subjected to the action of a force, but not if (in the rest condition) the piston element is not actuated. That advantageously and effectively provides that an unnecessary (unintentional) discharge flow of adhesive out of the discharge end is prevented as soon as an operator ceases to actuate the piston element.

In that respect it has proven to be particularly preferred (best mode) for the valve means to be in the form of a ball pressure valve and as a further preferred feature for a closure ball of the ball pressure valve to be caused to act against the force of a spring, in particular a coil spring. The counteracting pressure or the closing force can then be adjusted by virtue of a suitable selection of the spring.

There is also the further advantage that the meterability action of the device is also facilitated from the point of view of a user in practical use of the device by virtue of the counteracting pressure which is predetermined or which can be predetermined by virtue of the choice of spring, insofar as practical application of the adhesive to a work location is also markedly facilitated thereby.

It is further preferred for the ball pressure valve to be of a modular nature, that is to say the members involved in the valve operation, in particular the spring and the ball, are provided in an associated housing and that housing is then to be provided in the form of a module in the spout portion of the adhesive cartridge so that simplified fitment of the module is possible.

With those measures the invention therefore makes it possible further to improve the properties of use, which in any case are already comfortable, of cartridge-based hot-melt adhesive applicator devices, insofar as more specifically the improved adhesive cartridges afforded in accordance with the present invention combine advantageous technical properties in operation, for example in terms of heat transfer, with simplicity of manufacture which is suitable for large-scale series production, while also affording protection from the accidental discharge of adhesive, and additionally improving the metering properties and thus facilitating in particular also professional use.

BRIEF DESCRIPTION OF THE DRAWINGS

Further advantages, features and details of the invention will be apparent from the description hereinafter of a preferred embodiment and with reference to the drawings in which.

DETAILED DESCRIPTION

Figure 1:
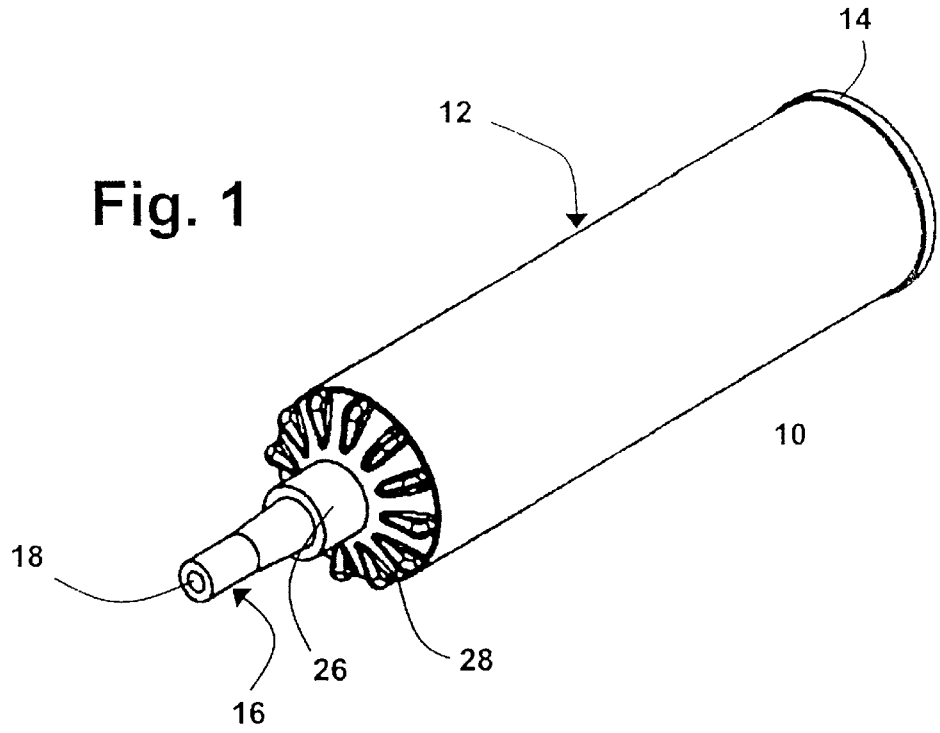
FIG. 1 is a perspective view of the adhesive cartridge in accordance with a first preferred embodiment of the invention.

An adhesive cartridge 10 shown in FIG. 1, as is intended for example for use in a hot-melt adhesive applicator device in accordance with the applicants' German protection right application 100 10 304.9, has a cylindrical cartridge body 12 which is formed in one piece from an aluminum material and which, with an outside diameter of between about 28 and 29 mm, is of an overall length of about 140 mm.

At a rearward end of the cartridge body 12 it is open for the insertion of a piston (not shown in the drawing) which is actuable for adhesive expulsion and metering purposes and which in a further preferred feature is sealed by a sealing means in relation to an inside wall surface of the cartridge body 12, the aluminum material forming a ridge 14 around the open end.

At the other end the cylindrical cartridge body 12 forms a transition into a cylindrical spout portion 16 which at the end provides a front outlet opening 18.

Figure 5:
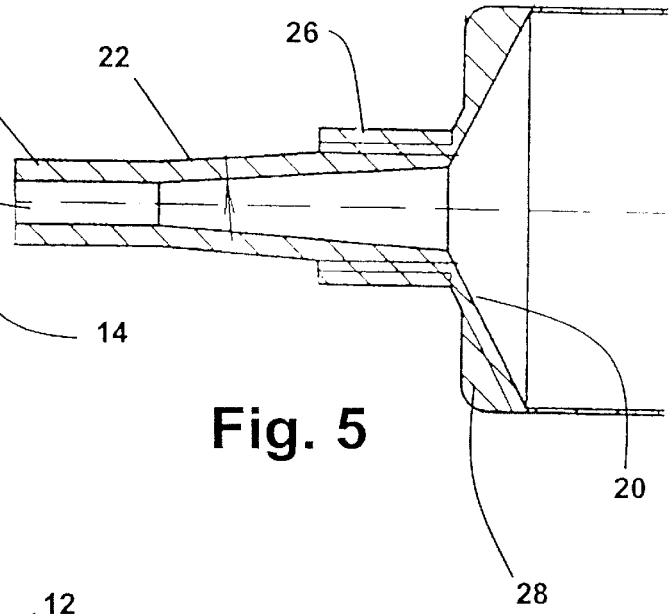
FIG. 5 is a view in section through the spout portion of the adhesive cartridge in accordance with the first implementation of the invention.

As can be seen in particular from FIG. 5 in this arrangement the internal cross-section of the spout portion taperingly decreases from a shoulder region 20 which bears directly against the cylindrical cartridge body 12, by way of a central region 22, to a tip region 24 of the spout portion 16, the tip region forming the outlet opening 18. In this arrangement the inside diameters extend conically in portion-wise manner, with the exception of the diameter in the tip region 24.

Figure 4:
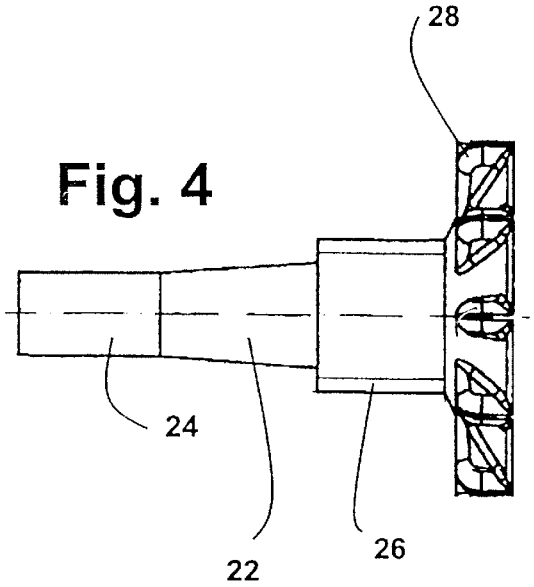
FIG. 4 is a detail side view of the spout portion of the adhesive cartridge of FIGS. 1 through 4.

As can also be particularly clearly seen from the detail views in FIGS. 4 and 5, formed on the spout portion 16, in immediately adjacent relationship to the shoulder region 20, is a male screwthread 26 which is adapted to co-operate with a closure cap (not shown in the drawing, having a corresponding female screwthread), thereby affording the possibility of closing the illustrated cartridge after use.

In order to secure the adhesive cartridge 10 in respect of rotary movement with respect to an electrically heatable heating element into which the cartridge is fitted and which is designed for example in accordance with DE 100 10 304.9, the cartridge in the shoulder region 20 has a plurality of radially outwardly extending nose-shaped projections which are arranged in a star configuration and which in an inserted condition of the adhesive cartridge into the heating element, fix the adhesive cartridge in its position relative to the heating element by virtue of the projections co-operating with suitable receiving means (not shown) in the hot-melt adhesive applicator device. In that respect it is to be borne in mind that in the procedure for expelling the adhesive by actuation of the expelling piston, a force acting in a direction towards the outlet opening 18 is in any case exerted on the cartridge so that the rotation-preventing action is achieved at a very low level of complication and involvement.

Figure 2:
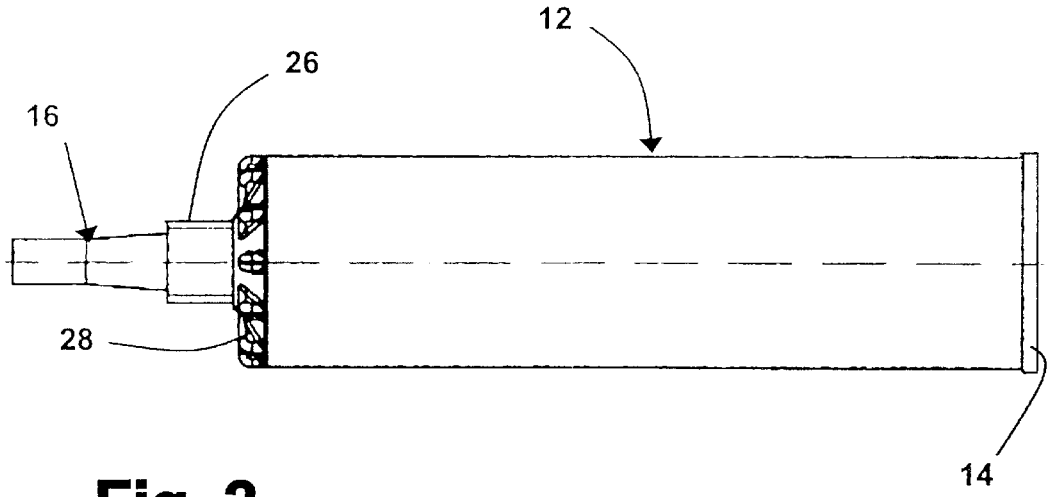
FIG. 2 is a side view of the cartridge of FIG. 1.
Figure 3:
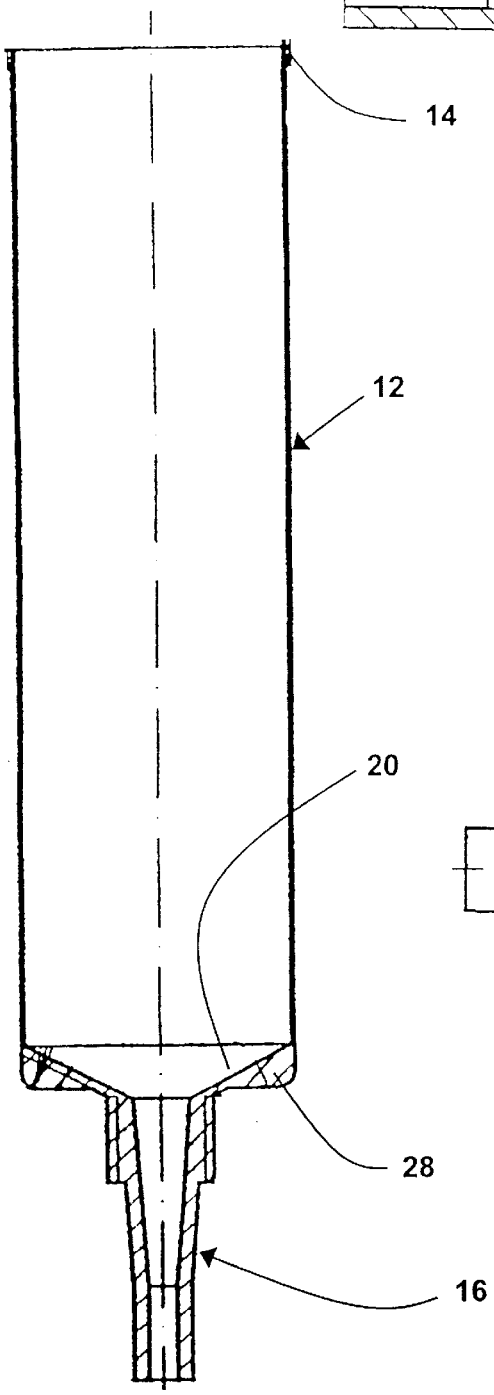
FIG. 3 is a view in longitudinal section through the adhesive cartridge of FIGS. 1 and 2.

As can also be seen from the side view of FIGS. 2, 4 and 5, the nose-shaped projections 28 are each of a contour which converges to a tip at the edge and they extend radially towards the edge to the outside diameter of the cartridge body 12 but not beyond same.

In use therefore the adhesive cartridge of the described embodiment is fitted into an associated hot-melt adhesive unit, for example in accordance with DE 100 10 304.9 (which, in respect of the heating element and further functional units co-operating with the adhesive cartridge, is to be deemed to be incorporated to its full extent into the present application as forming part of the present invention). By virtue of electrical heating of the heating element the heating element, by means of its cylindrical inside surface, transfers heat to the present adhesive cartridge according to the invention, whereupon then the adhesive which is disposed therein and which is heat-soluble dissolves and becomes ready for use. In addition, by virtue of the rotation-preventing means according to the invention, the cartridge is held in a fixed relative position with respect to the heating element (heating unit), such as to permit good efficient transfer of heat, so as to avoid particular problems due to defective transfer of heat by virtue of unsatisfactory thermal contact which could then result in premature cooling of the adhesive in the cartridge.

Figure 6:
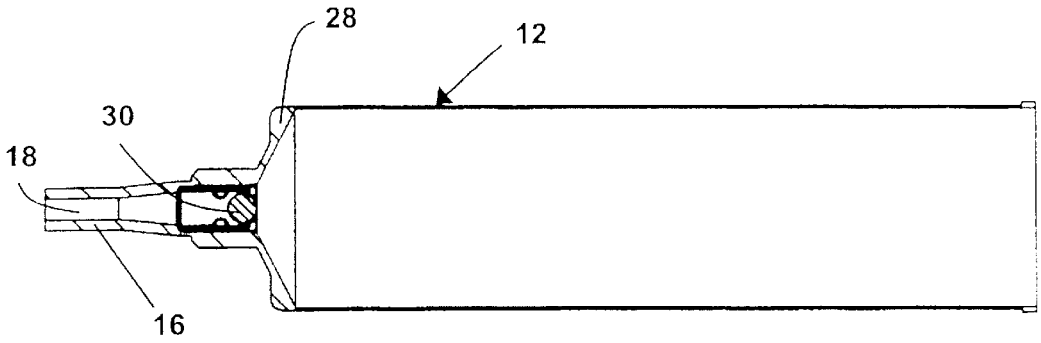
FIG. 6 is a view in longitudinal section through the adhesive cartridge in accordance with the second implementation of the invention.
Figure 7:
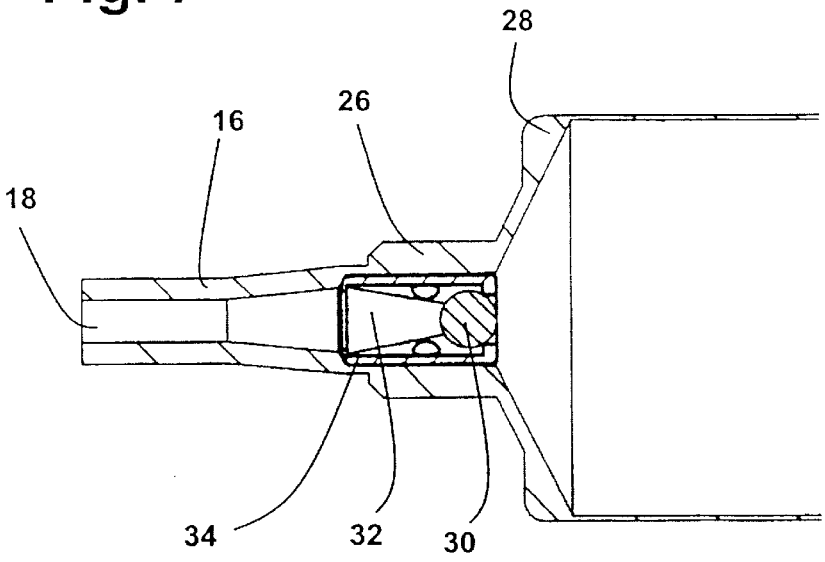
FIG. 7 is a detail sectional view of a preferred embodiment (best mode) of the valve means in the spout portion of the adhesive cartridge in the second implementation of the invention.

As can also be clearly seen from the sectional views of FIGS. 6 and 7 relating to the second implementation of the invention, provided in the region of the spout portion is a ball pressure valve which is contained in a housing 34 and which, in a direction towards an outlet end of the cylindrical region of the cartridge body 12, has in an otherwise known manner a valve closure ball 30 which is biased in the closure direction in the housing 34 by the force of a coil spring 32 (preferably of a cylindrical configuration). In that way therefore a counteracting pressure which can be set or predetermined by the spring force of the spring 32 is built up on the ball, against the medium issuing from the cartridge body in a direction towards the ball pressure valve or the outlet 18 (the medium typically being liquid or liquefied adhesive), so that firstly that force can be overcome by the liquid medium before the ball 30 opens the opening in the housing and therewith the discharge opening.

In use, actuation of the piston from the rearward opening of the cartridge body 12 then causes the application of a pressure to the liquid medium, and that pressure is continued to the ball valve; as soon as the pressure force exceeds the spring force acting in the opposite direction on the ball 30 the ball pressure valve opens and the adhesive can issue through the spout 16 or the outlet opening 18 in the prescribed manner.

However, as soon as an operator interrupts the application of pressure to the adhesive medium in the cartridge body 12, the counteracting pressure on the ball 30 due to the spring 32 is again greater than the fluid pressure so that, as from that moment, the ball pressure valve reliably closes the device at the outlet end; that can therefore prevent in particular disadvantageous leakage or the like as is known from the state of the art.

A further advantageous action of the invention further provides that quantitative metering of the liquid adhesive is markedly facilitated by virtue of the spring force on the valve ball 30, which can be adjusted or preselected (by virtue of suitable dimensioning), as now, in contrast to the state of the art, a defined constant force is to be overcome before the adhesive can issue from the opening 18.

The present invention is not limited to the described embodiments; thus in principle it is possible for the valve means, as in the described embodiment, not only to be designed in the form of a ball pressure valve (which is of a modular design configuration for assembly purposes), but in principle it is also possible to envisage other valve configurations which are suitable for the intended purpose of use. A corresponding consideration applies in regard to the configuration of the cartridge itself, which is to be interpreted only purely by way of example and can be applied to any forms which are suitable for liquid adhesive or adhesive which is to be liquefied.

The adhesive cartridge according to the invention also permits extremely simple replacement for, without the need to release any screws or the like, the cartridge can be removed without any problem from the heating element (in a direction in opposite relationship to the outlet opening), preferably after the outlet opening has been safeguarded by a closure which is suitably screwed on by means of the male screwthread 26.

What is claimed is:

1. An adhesive cartridge (10) for acommodating liquid adhesive or adhesive which is to be liquefied and for insertion into a hot-melt adhesive applicator device, comprising a cylindrical cartridge body (12) having a periphery adapted for heating by a heating element of the hot-melt adhesive applicator device, which heating element acts on the cartridge at the periphery thereof in an at least region-wise manner, which cartridge body is adapted at one end for closure with an insertable piston element and at the other end has a spout portion (16) providing an internal crosssection which is reduced with respect to the cylindrical cartridge body and which has an outlet end (18), wherein the adhesive cartridge has means (28) on the other end for preventing rotation of the adhesive cartridge in an inserted condition relative to at least one of (1) the hot-melt adhesive applicator device and (2) the heating element, wherein said means (28) comprises a plurality of projections which diverge in a direction extending radially toward the periphery of the cartridge body (12) and wherein the plurality of projections extend to but not beyond the periphery.

2. A device as set forth in claim 1 wherein the rotation-preventing means (28) diverge from a location in the region of the spout portion (16).

3. A device as set forth in claim 1 wherein the rotation-preventing means has a plurality of projections (28) which extend from a shoulder region (20) of the spout portion in a direction extending parallel to a longitudinal axis through the cylindrical cartridge body (12).

4. A device as set forth in claim 3 wherein the projections are in the form of noses (28) which are formed in one piece on the spout portion (16).

5. A device as set forth in claim 1 wherein the rotation-preventing means is in the form of a plurality of radially outwardly extending projections (28) arranged in a star configuration around a longitudinal axis through the cylindrical cartridge body (12).

6. A device as set forth in claim 1 wherein the adhesive cartridge is made from metal.

7. A device as set forth in claim 6 wherein the metal is aluminum.

8. A device as set forth in claim 1 wherein the cartridge body and the spout portion are made in one piece.

9. A device as set forth in claim 1 wherein the spout portion has a male screwthread (26) which is formed on a part thereof and which is adapted for securing a closure cap for closing the discharge end.

10. A device as set forth in claim 1 wherein the internal cross-section of the spout portion taperingly decreases along a plurality of parts (20, 22, 24) of the spout portion in a direction towards the discharge end with conical cross-sectional configurations which decrease in their gradient.

11. A device as set forth in claim 1 wherein sealing means is provided between the piston element and an inside wall surface of the cartridge body.

* * * * *